United States Patent [19]

Heintz

[11] 4,369,021

[45] Jan. 18, 1983

[54] FREE-PISTON ENGINE PUMP

[76] Inventor: Richard P. Heintz, 1841 Oakland Dr., Kalamazoo, Mich. 49001

[21] Appl. No.: 150,390

[22] Filed: May 16, 1980

[51] Int. Cl.[3] ..... F04B 17/00

[52] U.S. Cl. ..... 417/364; 417/393

[58] Field of Search ..... 417/364, 380, 393, 532; 123/46 R, 46 B, 46 SC, 41.41

[56] References Cited

U.S. PATENT DOCUMENTS

| | | | |
|---|---|---|---|
| 170,008 | 11/1875 | McCormack et al. | 417/532 X |
| 2,544,605 | 3/1951 | Mallory | 123/41.41 |
| 2,564,052 | 8/1951 | Chiville, Sr. | 417/364 X |
| 2,819,704 | 1/1958 | Niederman | 123/41.41 X |
| 2,872,778 | 2/1959 | Dane | 417/364 X |
| 3,046,958 | 7/1962 | Bard | 123/46 SC |
| 3,149,773 | 9/1964 | Cudahy | 417/364 |
| 3,174,432 | 3/1965 | Eickmann | 417/364 X |
| 3,816,031 | 6/1974 | Joyce, Sr. | 417/364 |
| 3,853,100 | 12/1974 | Braun | 123/46 SC |
| 4,040,772 | 8/1977 | Caldarelli | 417/364 |
| 4,087,205 | 5/1978 | Heintz | 417/11 |

*Primary Examiner*—Leonard E. Smith

*Attorney, Agent, or Firm*—Blanchard, Flynn, Thiel, Boutell & Tanis

[57] ABSTRACT

A free piston engine pump system operates in response to internal combustion for pressurizing a working fluid to provide hydraulic power output. The free piston engine pump has double acting power pistons and pumping pistons fixedly attached as a main reciprocating member and movable relative to a housing, which itself may be relatively movable for mass balancing purposes. Air is supplied and exhaust products are exhausted from a pair of opposite combustion chambers by respective common intake and common exhaust valves that preferably are operated by a common actuator in direct or indirect (via a phasing valve) response to position of the main reciprocating member. Moreover, operation of fuel injectors and exhaust valves associated with respective combustion chambers is directly or indirectly (via the phasing valve) controlled in response to the position of the main reciprocating member in the housing and/or fluid pressure in respective pumping chambers. A pressure responsive cycling valve controls operation of the free piston engine pump to initiate start-up, and a cooling air control valve controls delivery of cooling air to the exhaust valves and passages during each exhaust cycle.

42 Claims, 13 Drawing Figures

FIG. 2
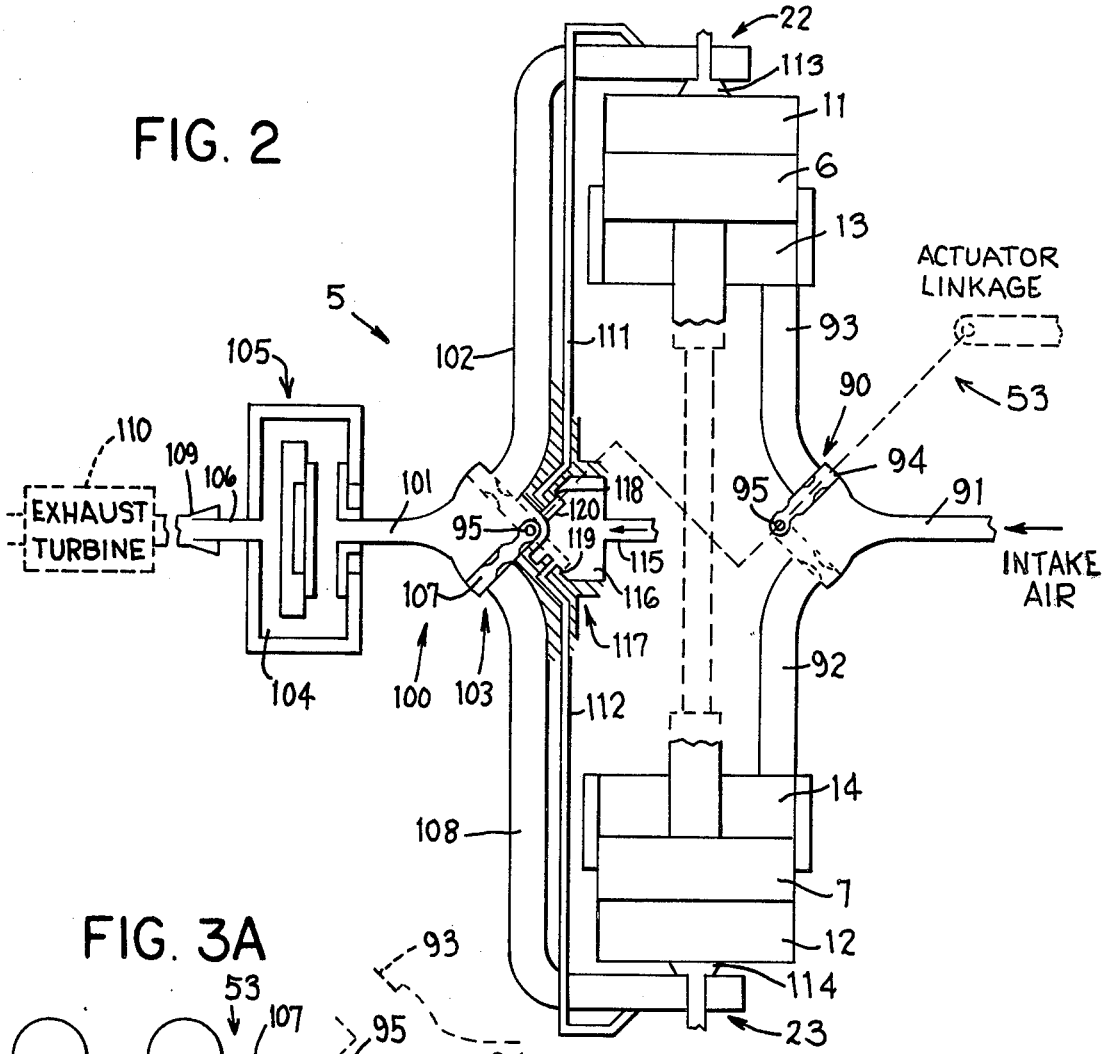
FIG. 3A
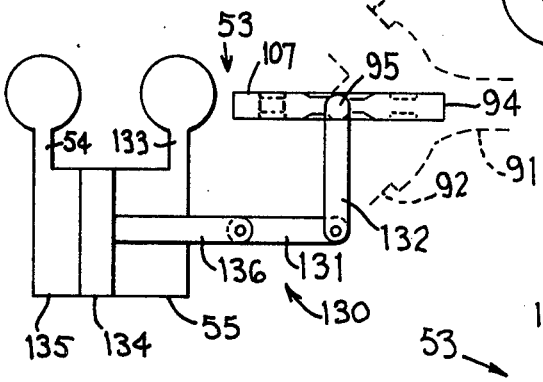
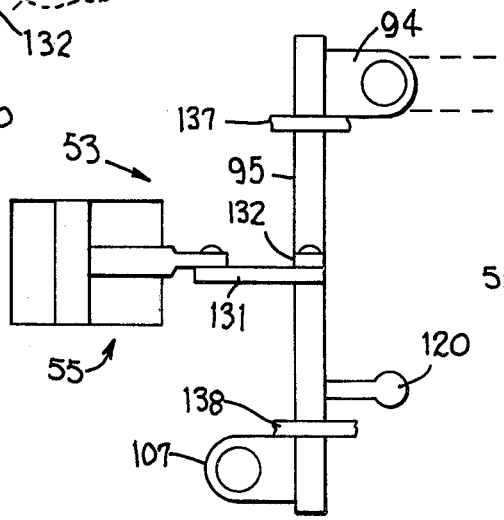
FIG. 3B
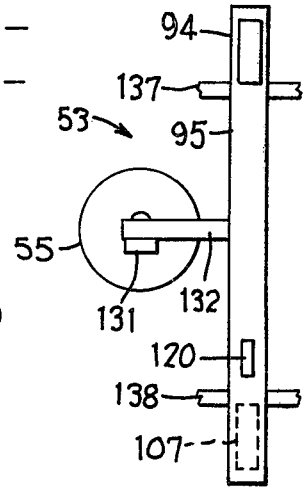
FIG. 3C

FIG. 5
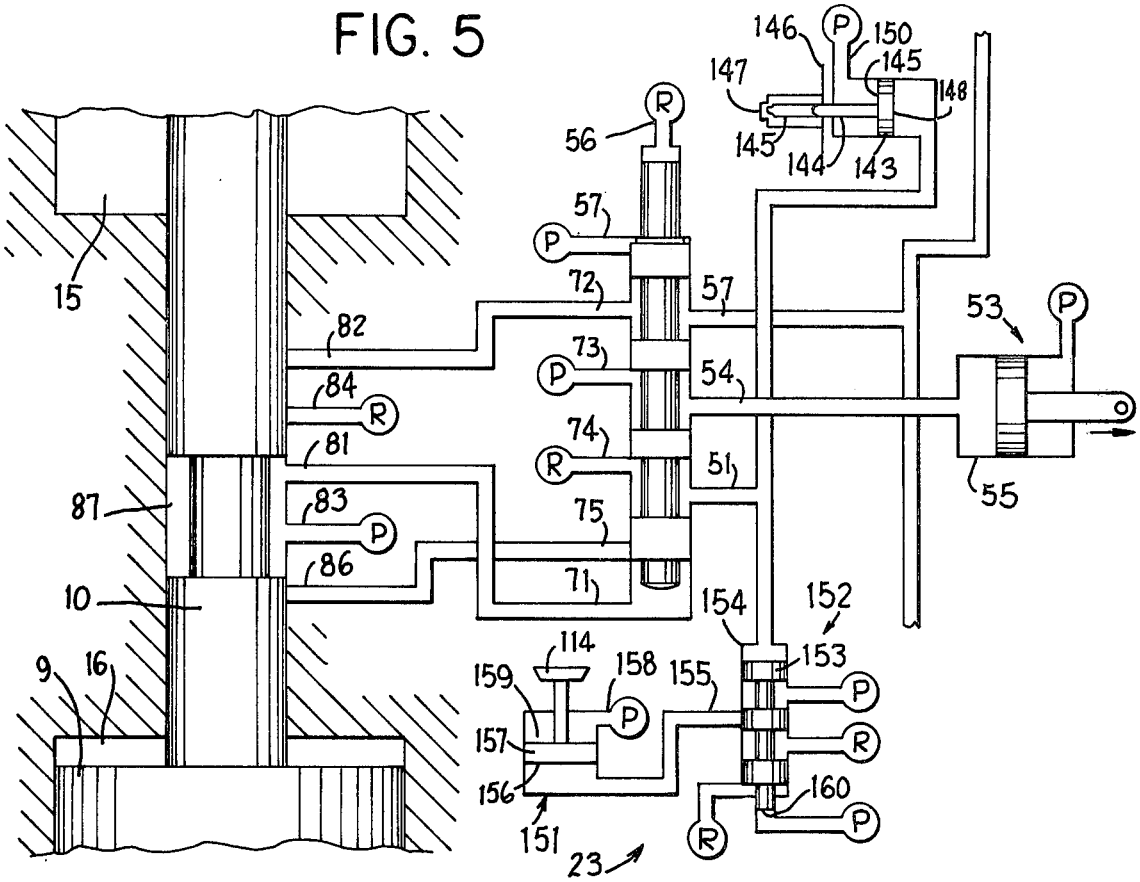
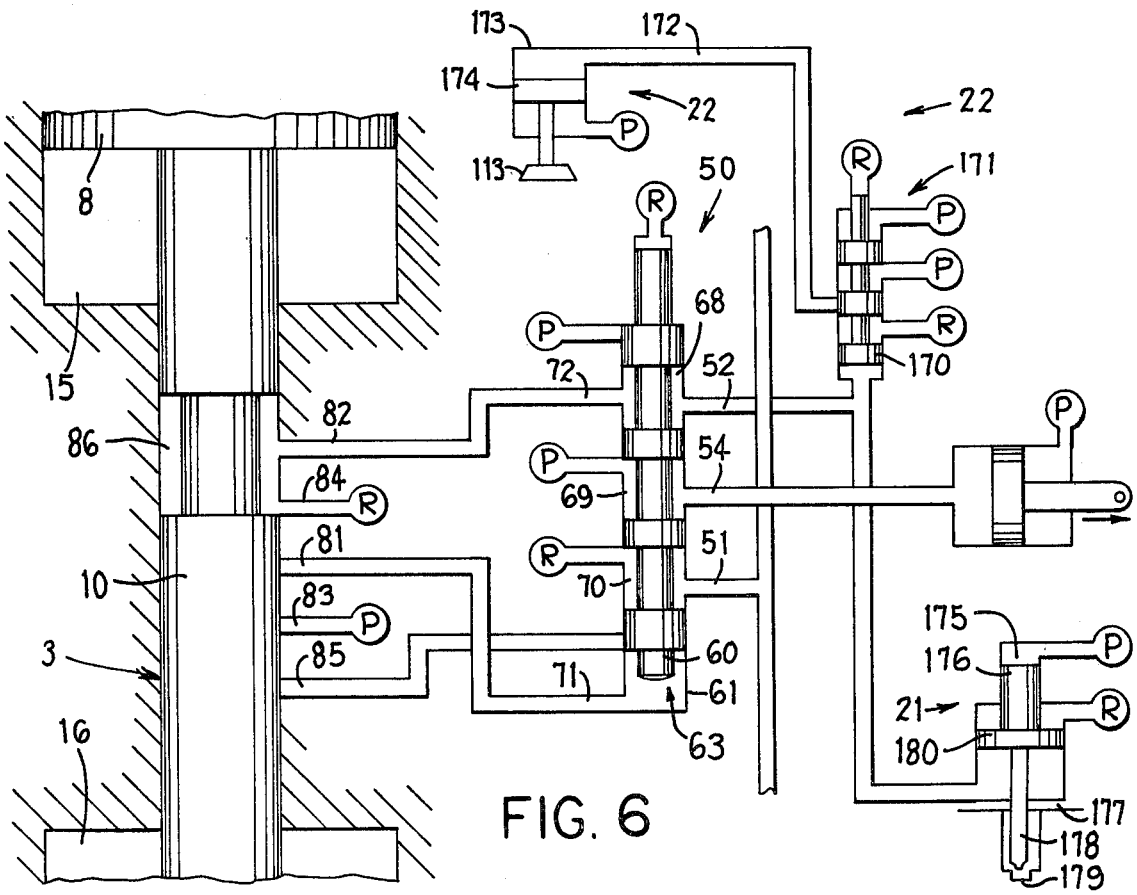
FIG. 6

FREE-PISTON ENGINE PUMP

BACKGROUND OF THE INVENTION

This invention relates to power generating equipment to provide a source of fluid, preferably hydraulic, power, and, more specifically, the invention relates to free piston engine pumps for generating such fluid power.

As will be appreciated by those familiar with hydraulic power systems, such systems are desirably highly efficient, low in cost, compact, light in weight and emit to the atmosphere a low level of pollutants. However, known systems which attempt to conform to these requirements are characterized by deficiencies in one or more respects, including, for example, the requirement of costly maintenance and resulting in certain inconveniences to the user.

A free piston engine pump unit which generates hydraulic power in response to internal combustion and which provides improvements over prior hydraulic power generating equipment is disclosed in U.S. Pat. No. 4,087,205, the disclosure of which is hereby incorporated by references. In such unit a main reciprocating member (hereinafter sometimes referred to as "member"), which includes a pair of reciprocating, mechanically connected power pistons and pump pistons, is movable in respective bores of a housing in response to internal combustion occurring in opposite combustion chambers to pump fluid from respective opposite pump chambers. Check valves control low pressure fluid flow into and high pressure fluid flow out from respective pump chambers, and a series of one-way valves controls fluid flow within the unit, which also develops a pressurized air supply to support combustion in the combustion chambers. A cycling valve assembly supplies fluid alternately to the respective pump chambers to force movement of the member during start-up of the unit: direct mechanical connections by toggle pins feed back to the cycling valve assembly information concerning the member to control such fluid flow during start-up. Several arrangements for injecting fuel into the respective combustion chambers also are disclosed in such patent.

SUMMARY OF THE INVENTION

The present invention is directed to an improved free piston engine pump for generating fluid power that may be employed for a variety of purposes including, for example, motive power for a vehicle. The invention will be described particularly with reference to the generating of hydraulic power; however, it will be appreciated that the invention may be employed to generate other types of fluid power.

Accordingly, a primary object of the invention is to provide a source of hyraulic power which is efficient, compact, and relatively low in cost and which emits a minimum of environmental pollutants during operation.

Another object is to provide an improved free piston engine pump employing a single main reciprocating member driven cyclically by dual opposed combustion chamber pistons and in turn driving integral dual opposed hydraulic pumping pistons in respective pump chambers, such arrangement being referred to below as a double-acting configuration of free piston engine pump.

An additional object is to enable free movement in one axis of a free piston engine pump casing or housing such that its motion cancels out the acceleration of the main reciprocating member thereof.

A further object is to facilitate removal of combustion products, especially from the combustion chambers of a free piston engine pump, by gas inertia effect associated with quick blow-down through a long exhaust pipe.

Still another object is to capture exhaust blow-down energy by a plenum valve and chamber in the exhaust system of a free piston engine pump, and, further, to use such captured exhaust energy to drive an auxiliary mechanism such as an exhaust turbine.

Still an additional object is to facilitate exhaust control of a free piston engine pump preferably by employing a single moving member as an exhaust valve and a common plenum chamber for plural exhaust lines from the combustion chambers.

Still a further object is to cool the exhaust valves of a free piston engine pump, especially by filling the exhaust pipes with cool air at selected times during cyclical operation of the free piston engine pump.

Even another object is to improve the delivery system of fresh air in a free piston engine pump, including the provision of fresh air scavenge pumping action from the "crankcase" side of each combustion chamber piston through cylinder wall porting to the combustion chamber and/or by facilitating control of fresh air supply by a single moving intake valve member that controls intake air flow to respective combustion chambers from a common air source.

Even a further object is to employ gas inertia particularly in the delivery of air to respective combustion chambers of a free piston engine pump to obtain a supercharging effect.

Yet another object is to facilitate efficient control of intake and exhaust plenum valve functions by common actuation means, and especially to effect the same using hydraulic pressure.

Yet an additional object is to effect controlled hydraulic fluid operation of fuel injectors and exhaust valves in a free piston engine pump.

Yet a further object is to provide phasing valve control of various control fluid input and output functions in a free piston engine pump, and especially to effect the same by a common phasing valve that is operative in response to position of the main reciprocating member of the free piston engine pump.

Also, another object is to provide fluidic control of a cycling valve for starting and terminating starting operation of a free piston engine pump.

Also, an additional object is to facilitate regulating the quantity of fuel injected in a free piston engine pump to assure self-sustained operation.

These and other objects and advantages of the present invention will become more apparent as the following description proceeds.

Briefly, a free piston engine pump in accordance with the present invention includes a housing defining first and second bores therein, a main reciprocating member including first and second interconnected simultaneously reciprocating pistons slidable in the respective bores, each piston having a power piston portion coacting with a respective bore to define a combustion chamber adjacent one end thereof and a pumping piston fixed relative to the power piston and coacting with the respective bore to define a pump chamber adjacent the other end thereof. According to one aspect of the invention, a common air intake receives air and is coupled to deliver such air to respective combustion chambers by a common intake valve, and according to another aspect of the invention a similar common exhaust valve alternately couples respective exhaust passages from the combustion chambers to a common exhaust outlet, which may include a plenum arrangement for storing and/or extracting residual energy from the exhaust products; therefore, the common exhaust valve may be referred to interchangeably below as a common exhaust plenum valve. Another aspect of the invention includes automatic hydraulic operation of separate exhaust valves of the combustion chambers, either directly from the pump chambers or indirectly therefrom via a phasing valve and/or a booster valve. Injection of fuel to the combustion chambers may be directly in response to fluid pressure in the respective pump chambers or in response to fluid pressure controlled by a phasing valve in dependence on position of the main reciprocating member. Such a phasing valve also may control operation of common intake air and common exhaust plenum valves as well as the separate exhaust valves directly associated with the respective combustion chambers. For starting the free piston engine pump, a cycling control valve, which receives hydraulic feed-back information indicative of the position of the main reciprocating member, supplies pressurized working fluid into the pump chambers to reciprocate such member until the engine is started. Such hydraulic feed-back eliminates the need for mechanical confrontation type feedback to operate the cycling control valve, thus minimizing wear and increasing the integrity of the system. In one embodiment of the invention the free piston engine pump housing is movable to counterbalance combustion forces, and sliding connections are provided between fluid passages in the movable housing and relatively stationary passages, such as, for example, hydraulic fluid lines, exhaust lines, etc. of the system, e.g. a vehicle, in which the free piston engine is employed. Other features of the invention include a convenient valve mechanism to deliver cooling air to the separate exhaust valves to cool both the valves and the exhaust lines and to enhance flow of combustion products through the exhaust lines.

BRIEF DESCRIPTION OF THE DRAWINGS

In the annexed drawings:

FIG. 2 is a fragmentary section view of the free piston engine pump of FIG. 1 showing the pneumatic portions thereof;

FIGS. 3A, 3B and 3C are, respectively, top, side, and end views of the fresh air and exhaust common valve mechanisms for the free piston engine pump;

FIGS. 4, 5, 6 and 7 are fragmentary section views, partly in schematic form, depicting operation of the free piston engine pump of FIG. 1;

DESCRIPTION OF THE PREFERRED EMBODIMENT

Figure 1:
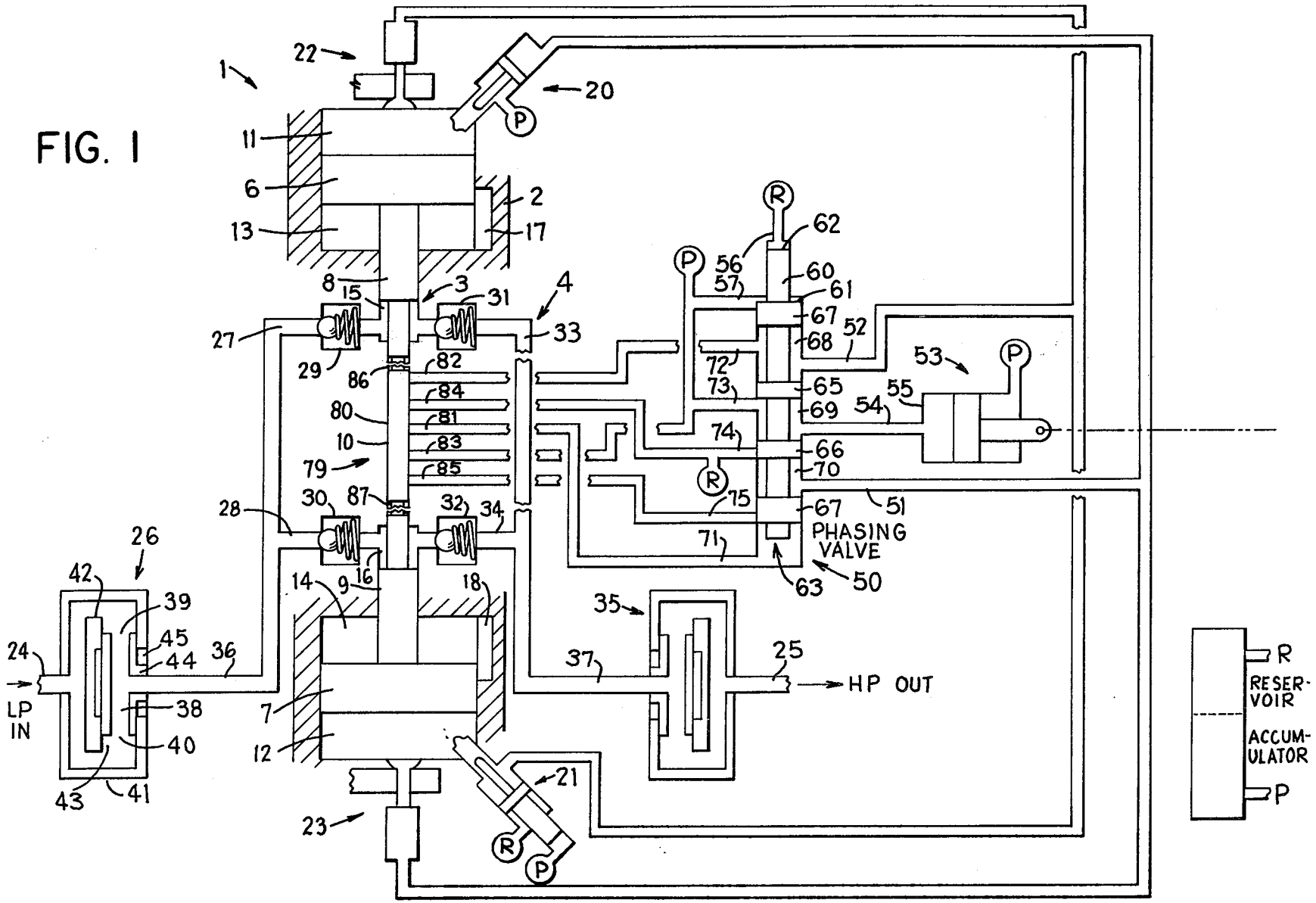
FIG. 1 is a section view, partly in schematic form, of a free piston engine pump in accordance with the present invention, showing the various hydraulic portions thereof.
Figure 4:
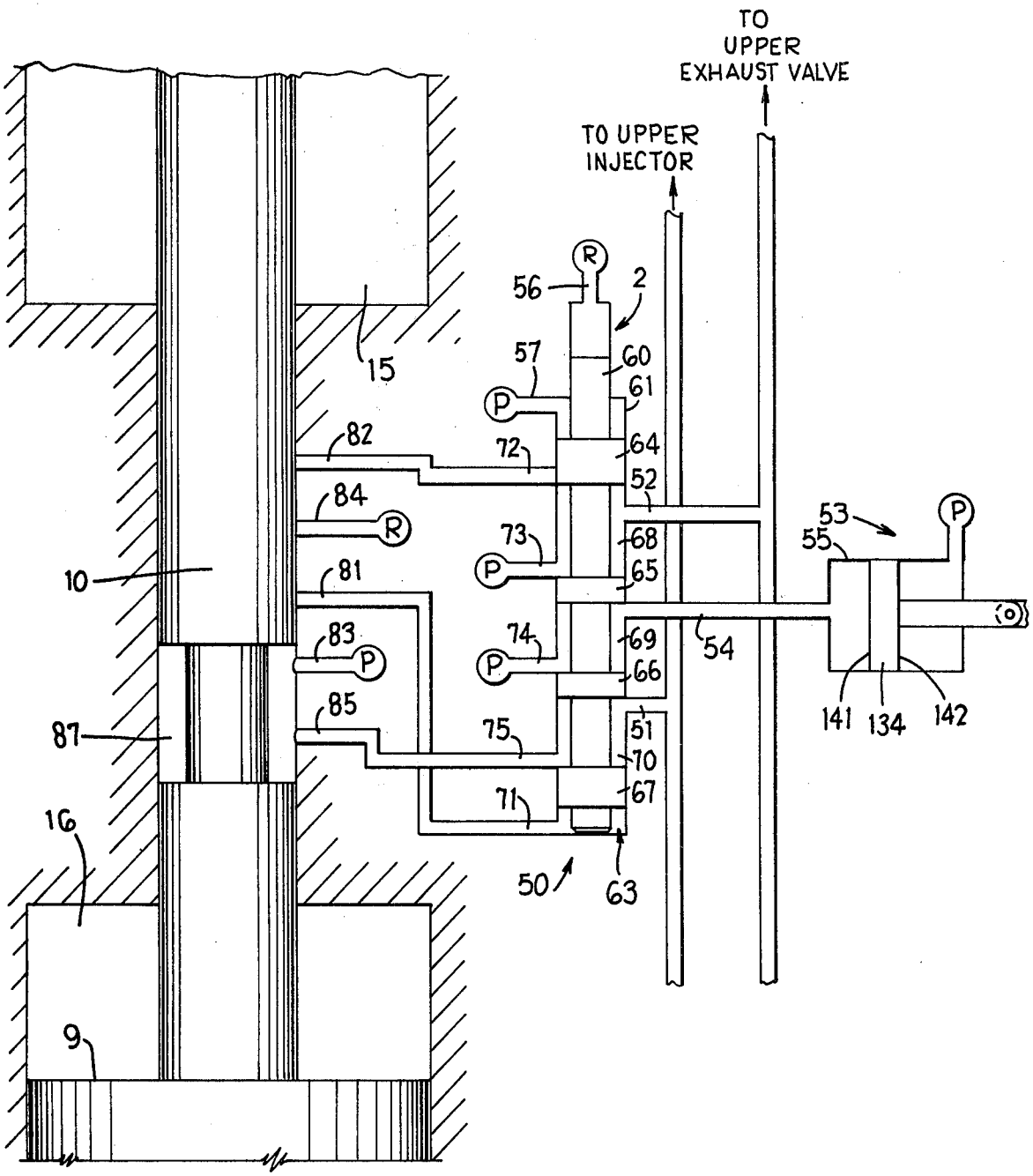

In referring in detail to the drawings, certain terminology will be used for convenience of description only and is not intended to be limiting. For example, the words "upwardly", "downwardly", "rightwardly", and "leftwardly" will refer to directions in the drawings to which reference is made. The words "inwardly" and "outwardly" will refer to directions toward and away from, respectively, the geometric center of the system and designated parts thereof. Such terminology will include the words specifically mentioned above, derivatives thereof, and words of similar import.

Turning particularly to FIG. 1, a free piston engine pump in accordance with the present invention is generally indicated at 1. It will be appreciated that the several illustrations of the free piston engine pump 1 presented in the drawings are not to scale but rather are presented generally in schematic cross-sectional diagramatic form for understanding together with the accompanying description and understanding of the parts and operation of the invention. The pump 1 includes a casing or housing 2, which provides structural support and containment for the several functioning elements of the pump, a main reciprocating member 3, which is formed of several cylindrical sections that are mated with corresponding bores in the casing 2 to limit motion in one axial direction relative to the casing, and associated valving and flow lines, both of the hydraulic type 4 shown in FIG. 1 and the pneumatic type 5 shown in FIG. 2, for conducting fluid flow in the pump 1. The cylindrical sections of the member 3 are upper and lower power pistons 6, 7, upper and lower pump pistons 8, 9, and a center rod 10, which mechanically couples the upper pistons with the lower ones for simultaneous reciprocating movement thereof in the casing 2. The pistons cooperate with the casing 2 to form respective chambers, including upper and lower combustion chambers 11, 12, upper and lower scavenge chambers 13, 14, and upper and lower pump chambers 15, 16.

An upper air intake port 17 provides communication between the upper scavenge chamber 13 and the upper combustion chamber 11 around the upper power piston 6 when the latter is located in its generally lowermost position, i.e. the member 3 is near bottom dead center (BDC) position. Similarly, a lower air intake port 18 provides communication between the lower scavenge chamber 14 and the lower combustion chamber 12 when the lower power piston 7 is near its uppermost position, i.e. the member 3 is near its top dead center (TDC) position. Fuel is supplied to the respective combustion chambers 11, 12 from respective upper and lower fuel injectors 20, 21, and exhaust gases are removed from the respective combustion chambers by separate respective upper and lower exhaust valves 22, 23.

Hydraulic fluid for pumping is supplied to the pump chambers 15, 16 from a low pressure hydraulic fluid input line 24, which may be connected to a reservoir (R) source of relatively low pressure hydraulic fluid and high pressure hydraulic fluid produced by the pump 1 is supplied to a high pressure hydraulic fluid output line 25, which may be connected to an external device, not shown, to do work on the same, to a high pressure accumulator, etc. Connections to the reservoir and accumulator, respectively, are designated "R" and "P" in the drawing and the relatively low and high pressure fluid magnitudes thereof are designated, respectively, "R" and "P" in the specification. More particularly, the input line 24 is connected by a sliding connection 26 to respective separate upper and lower input lines 27, 28 and upper and lower input check valves 29, 30 to the upper and lower pump chambers 15, 16 to supply hydraulic fluid to the latter while the respective upper or lower pump pistons 8, 9 are moving in a direction to expand such chambers. Upper and lower output check valves 31, 32 couple high pressure fluid pumped from the respective pump chambers as the respective pump pistons 3, 4 are moving in a direction to reduce the volume in the respective pump chambers, to respective separate upper and lower output lines 33, 34, which are connected by a further sliding connection 35 to the high pressure hydraulic fluid output line 25.

The sliding connections 25, 35 are similar and are provided to connect the fluid input and output lines 36, 37, which preferably are fixedly mounted with respect to the casing 2, to the hydraulic fluid input and output lines 24, 25, while permitting movement of the casing 2 with respect to the lines 24, 25. Such limited movement of the casing 2 permits countermovement of the casing to balance the reciprocating forces occurring in the main reciprocating member 3 during operation of the pump 1. Such limited movement is constrained by means not shown such that it is permitted only in the same axial direction as that of movement of the member 3. Such casing movement is preferred and in some instances may be required for double-acting configured free piston engine pumps of the type illustrated at 1 in FIG. 1 while preferably avoiding additional mass balancing requirements.

The sliding connection 26 includes a T-port 38 with respective open ends 39, 40, preferably of cylindrical configuration, that open into a fluid chamber structure 41. Integral with the structure 41 are bores 42, 43 which are configured sealingly to accommodate the T-port ends 39, 40 and in which the latter respectively can freely slide. The T-port ends 39, 40 may be part of an extension member 44 that is attached to the fluid line 36, and such member is permitted to slide within the linear limits defined by a slot type opening 45 in the fluid chamber structure 41. Thus, low pressure hydraulic fluid may be supplied to the structure 41 from the hydraulic fluid input line 24 substantially filling such structure and flowing through the extension 44 and fluid line 36 to the pump chambers 15, 16 while the fluid line 36 and the rest of the casing 2 may move relative to the apparatus, say a vehicle or the like, with respect to which the input line 24 may be relatively fixed. If desired, O-rings or other seal mechanisms may be employed to assure the fluid-tight integrity of the sliding connection 26.

Although not described in detail, it will be appreciated that the further sliding connection 35 is similar to the just-described sliding connection 26 and is operative to couple high pressure hydraulic fluid from the pump chambers 15, 16 and fluid line 37 to the high pressure hydraulic fluid output line 25 in a fluid-tight flow path permitting movement of the casing 2, as aforesaid.

In accordance with the preferred embodiment and best mode of the invention, a phasing valve 50, which is controlled in response to the position of the member 3, controls operation of the fuel injectors 20, 21 and separate exhaust valves 22, 23 by providing high and low fluid pressures in fuel injector control port 51 and separate exhaust valve control port 52. The phasing valve 50 also controls delivery of intake air and exhaust connections in the pneumatics of the pump 1, as will be described in further detail below with reference to FIG. 2, by providing high and low fluid pressures to a pneumatics actuation sub-assembly 53 by connection via a pneumatics actuation sub-assembly control port 54 directly to a hydraulic fluid scavenge/plenum actuator 55. A source of relatively low pressure hydraulic fluid from reservoir R is connected to bias port 56, and a source of relatively high pressure hydraulic fluid P is connected to bias port 57 of the phasing valve 50.

Figure 7:
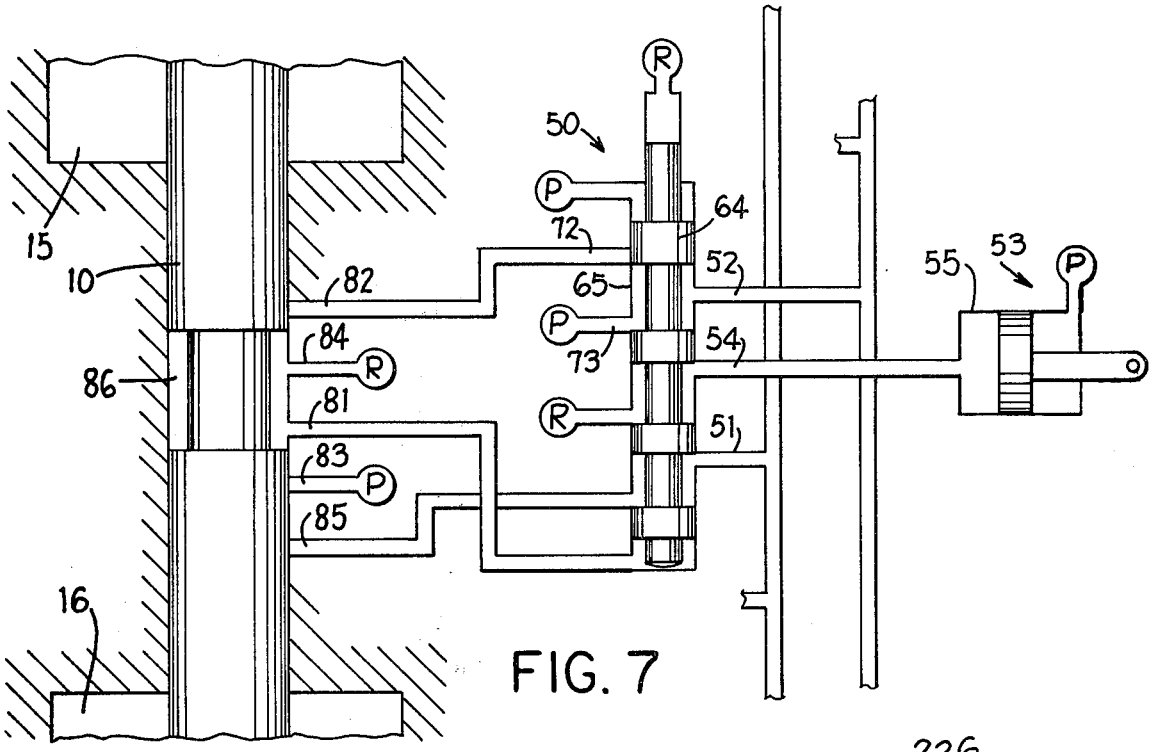

The phasing valve 50 preferably is a spool valve including a valve spool 60 that is movable in a valve housing 61. The valve spool 60 has upper and lower ends 62, 63 and lands 64–67 which define in the housing 61 respective substantially fluid-tight flow chambers 68–70. The spool 60 may be moved to an upper position, as is shown in FIG. 1, in response to high fluid pressure applied to the lower end 63 from a positioning port 71 and may be moved to a low position in the housing 61, as shown in FIG. 7, in response to a bias force developed by the fluids in the bias ports 56, 57 and a release of fluid pressure from the positioning port 71. Fluid connections from fluid ports 72–75 with respect to the several control ports 51, 52, 54 are made and blocked in dependence on the position of the valve spool 60 and the valve housing 61.

The phasing valve 50 not only operates in dependence on the position of the member 3 in the casing 2, but also cooperates with the member 3 during reciprocation thereof to effect accurately timed operation of the fuel injectors 20, 21 and separate exhaust valves 22, 23. Thus, the pump 1 has a flow control portion 79 including the center rod 10, which reciprocates in fluid-tight relation in a bore 80 of the casing 2, fluid ports 81–85, and upper and lower annular chambers 86, 87, which effect various connections of respectively adjacent fluid ports in dependence on position of the member 3. It is noted particularly that the annular chambers 86, 87 are only illustrated schematically in FIG. 1 and are illustrated in greater and more accurate detail in FIGS. 4–7 wherein cooperative operation of the phasing valve 50 and flow control portion 79 are depicted.

The pneumatics associated with the free piston engine pump 1 are illustrated in FIGS. 2 and 3A–3C. When a common scavenge air control valve 90, which is operated by the pneumatics actuation sub-assembly 53, is in the position shown in FIG. 2, fresh air is delivered from a common intake pipe 91 through a lower intake pipe 92 to the lower scavenge chamber 14; this occurs when the member 3 is moving downwardly. When the valve 90 is in the position shown by the dotted lines, fresh air from the common intake pipe 91 is supplied to the upper scavenge chamber 13 through an upper intake pipe 93, and this occurs when the member 3 is moving upwardly. Preferably the common scavenge air control valve 90 is of the type including a flapper 94, which is mounted on and rotatable with a shaft 95 of the pneumatics actuation subassembly 53.

In the exhaust system 100 of the pump 1 a common exhaust pipe 101 communicates with an upper exhaust pipe 102 when a common exhaust or plenum valve 103 is in the position shown by solid lines in FIG. 2. When the upper separate exhaust valve 22 is opened, spent combustion products in the upper combustion chamber 11 can flow to a plenum 104; this occurs while the member 3 is in its generally downmost position, but is still moving downward. The plenum 104 may be the fluid chamber structure of a still further sliding connection 105, which may be substantially the same as the above described sliding connection 26, that effects sliding coupling of the common exhaust pipe 101, which is movable with the casing 2, to the relatively fixed outlet exhaust line 106.

Preferably the common exhaust valve 103 includes a flapper 107 mounted on and movable with the shaft 95, i.e. the same shaft on which flapper 94 is mounted. As the flow through upper exhaust pipe 102 terminates, the common exhaust valve is operated by the pneumatics actuation sub-assembly 53 to the position shown by the dotted lines in FIG. 2 to prevent back-flow into the upper exhaust pipe 102. The upper exhaust valve 22 also closes, preventing fresh air, which is at this point flowing into upper combustion chamber 11, from exiting through the valve 22.

Preferably the common exhaust valve 103 does not provide a perfect seal so that leakage past the flapper 107 gradually equalizes the pressure between the common exhaust pipe 101 and the upper exhaust pipe 102. Also, when the valve 103 is in the position shown by the dotted lines, the common exhaust pipe 101 communicates with a lower exhaust pipe 108. As the lower exhaust valve 23 is opened, spent combustion products in the lower combustion chamber 12 can flow to the plenum 104, and events similar to those just described as occurring in the upper portion of the pump 1 will occur in the lower portion. The exhaust gases may exit from the plenum 104 and outlet exhaust line 106 through a nozzle 109, which may be part of an exhaust driven turbine 110. Such turbine may be employed to recover additional useful work from the flowing hot exhaust gases.

Cooling air may be provided to the separate exhaust valves 22, 23 through upper and lower cooling air passages 111, 112, which selectively deliver cooling air, i.e. preferably fresh air, directly into the upper and lower exhaust pipes 102, 108 at an area proximate the exhaust valve members 113, 114. The provision of such additional cooling air into the exhaust pipes 102, 108 increases flow therethrough and, accordingly, the flow of gases through the turbine 110. Such cooling air is received through intake pipe 115, which may be an extension of the common intake pipe 91, to a valve chamber 116 of a common cool air valve 117. The cool air valve 117 includes plural seats 118, 119, which may be selectively closed and opened by a flapper 120. Preferably the flapper 120 is mounted on the shaft 95 for rotation therewith so that when in the position shown in solid lines in FIG. 2 the flapper 120 closes against the seat 118 and thus closes the passage 111 while leaving the passage 112 open to receive cooling air, and vice versa. Cool air can flow through the lower cooling air passage 112, then, and can exit in the vicinity of the lower exhaust valve 23 to cool the valve member 114 and to force additional gas flow through the lower exhaust pipe 102 past the loose fitting flapper 107. When the common exhaust valve 103 is moved to the position shown by the dashed lines in FIG. 2, the flapper 120 of the cool air valve 117 moves to the position also shown by the dashed lines to block the lower cool air passage and to open the upper cool air passage for similar operation to cool the upper exhaust valve member 113 and to supply the upper exhaust pipe 102 and fresh air.

As shown in FIGS. 3A, 3B, 3C, the pneumatics actuation sub-assembly 53 has a mechanical linkage 130, including rigid links 131, 132 for rotating the shaft 95 in response to a work output from the scavenge/plenum actuator 55. When relatively low hydraulic fluid pressure R is delivered to the control port 54, the relatively high hydraulic fluid pressure P, which is coupled to a bias port 133, drives a movable piston 134 to the left in its actuator housing 135 while an output piston rod 136 operates through the mechanical linkage 130 to rotate shaft 95 clockwise bringing the flapper 94 into position closing the lower air intake pipe 92 and opening the upper air intake pipe 93. Such movement also rotates the flapper 107 of the common exhaust valve 103 into position to block the upper exhaust pipe 102 and the flapper 120 of the cool air valve 117 to block the lower cool air passage 112. Similarly, when the pressure at port 54 exceeds that at the bias port 133, the piston 134 will be moved to the right, thus moving the respective valves to their opposite positions from those described above. The mounting of flappers 94 and 107 on the common shaft 95, which preferably passes in fluid-tight engagement through walls 137, 138 of the respective valves 90, 103, and the mounting of flapper 120 also on the shaft 95 is most clearly seen in FIG. 3B. Of course, if desired, the various flappers may be mounted on separate shafts for operation by the common actuator 55 or by plural actuators.

Operation of the preferred embodiment and best mode of free piston engine pump 1 in accordance with the present invention now will be described with reference to FIGS. 4–7. When the pressure in control port 51 rises to pressure P, the lower exhaust valve 23 is opened and the upper fuel injector 20 is operated to inject fuel into the upper combustion chamber 11; when the pressure in control port 51 drops to pressure R, the lower exhaust valve is closed and the upper fuel injector is reset for another cycle. Similarly, when the pressure in control port 52 drops to R, the upper exhaust valve 22 is opened and the lower fuel injector 21 is operated to inject fuel into the lower combustion chamber 12; when the pressure in control port 52 rises to P, the upper exhaust valve is closed and the lower fuel injector is reset for another cycle. Such pressure changes are accomplished by the phasing valve 50, which also controls the pressure in actuator sub-assembly control port 54. More particularly, if the pressure in control port 54 rises to high pressure P, the scavenge/plenum actuator 55 is operated, whereupon the piston 134 is moved to the right since pressure area 141 is larger than pressure area 142, which continuously receives high pressure P; the righthand position of piston 134 is associated with the member 3 moving upward. Similarly, when the member 3 is moving downward, the pressure in control port 54 drops to low pressure R, and the piston 134 is moved to the left.

The lower annular chamber or flow annulus 87 is located in the center rod 10 near the lower pump piston 9, and when this assembly, as part of the member 3, approaches its uppermost position (FIG. 4) at which time the upper fuel injector 20 and lower exhaust valve 23 are to be operated, port 83, which is at high pressure P, can communicate through flow annulus 87 to port 85. With the phasing valve 50 in the position shown (FIG. 4), i.e. with the valve spool 60 in its lowermost position in the valve housing 61, such high pressure is communicated to control port 51 through flow chamber 70. Just prior to such communication, the control port 51 was at low pressure R, as will subsequently become evident. Further upward motion of the member 3 causes the flow annulus 87 to allow communication of high pressure port 83 with port 81 (FIG. 5). High pressure P is thereby allowed to communicate to the lower end area 63 of the valve spool 60 through the positioning port 71. Since the area 63 is larger than the upper end area associated with land 64 exposed to high pressure bias fluid through the bias port 57, the phasing valve spool 60 is moved upward to the position shown in FIG. 5. Such upward movement of the valve spool 60 allows the control port 51 to drop to low pressure R, completing the cycle associated with the member 3 being at its uppermost position. With subsequent downward motion of the member 3, the port 81 is blocked off by the center rod 10, as the flow annulus 87 is also moved downward, and the fluid trapped in port 81 has no place to go so that the valve spool 61 is prevented from further motion at this time, i.e. it is secured in its upper position.

Turning now to FIG. 5, the connections of control port 51 to the upper fuel injector 20 and lower exhaust valve 23 are shown, and the method of using the pressure in control port 51 will be described with respect to the same. The upper fuel injector 20 includes a movable piston actuator 143, injecting rod 144, injection chamber 145, and fuel supply line 146 and fuel outlet or nozzle 147, which are directly associated with the injection chamber 145. The piston actuator 143 will move to the left to cause injection of fuel when control port 51 pressure is equal to P since piston area 148 is greater than piston area 149. Retraction of the piston actuator 143 to the right for resetting purposes occurs when pressure from control port 51 on piston area 148 drops to R because piston area 149 is continuously subjected to high pressure P from bias port 150. The lower exhaust valve 23 is connected to the control port 51. The lower exhaust valve includes the valve member 114, which is moved by an exhaust actuator 151 in response to fluid pressure supplied by a booster valve 152. A high pressure in control port 51 drives the booster valve spool 153 downward in its housing 154 to permit communication of high pressure P through port 155 to a surface 156 of a piston actuator 157 in the actuator 151. High pressure P is supplied through port 158 to piston surface 159, but the higher force against surface 156 moves the piston actuator 157 and, thus, the valve member 114 upward to open the exhaust valve 23. When the pressure in control port 51 drops to R, the booster valve spool 153 moves upward in response to high pressure P supplied to lower end area 160, whereupon low pressure R is communicated to the port 155. The piston actuator 157 and exhaust valve member 114 move downward to close the exhaust valve 23. Use of respective booster valves, such as the booster valve 152, to operate the respective exhaust valves 22, 23 effects quite rapid movement of the respective exhaust valve members to open and close the exhaust valves thereby to optimize the exhaust gas inertia effect in the respect exhaust pipes 102, 108 and common exhaust pipe 101. Alternatively, the exhaust valves may be operated directly from the control port 51, for example, by coupling the port 155 to the control port 51.

As is shown in FIG. 6, when the member 3 approaches its downmost position, the upper annular chamber or flow annulus 86, which is located in the center rod 10 near the upper pump piston 8, permits communication between low pressure port 84 and port 82. Such low pressure R is further communicated through fluid port 72, flow chamber 68, and control port 52 of the phasing valve 50 to the upper exhaust valve 22 and to the lower fuel injector 21. Prior to such communication permitted by the flow annulus 86, the center rod blocked fluid flow through the fluid port 82. The low pressure R in control port 52 allows the spool 170 of the booster valve 171 associated with the upper exhaust valve 22 to move downward, whereupon high pressure P is communicated through port 172 to the exhaust valve actuator 173. The high pressure in port 172 moves a piston actuator 174 downward to open the exhaust valve member 113, as described above with reference to FIG. 5 and the exhaust valve 23. The low pressure in control port 52 also permits the high pressure P supplied to the upper end 175 of an injector piston 176 in the lower fuel injector 21 to move such piston actuator downward to inject fuel, which is provided from fuel supply line 177 to injection chamber 178, through the outlet or nozzle 179 into the lower combustion chamber 12.

Further downward motion of the member 3 allows fluid port 81 to communicate with low pressure port 84 through the flow annulus 86 allowing the previously trapped fluid in the positioning port 71 and phasing valve housing 61 below the lower end 63 of the phasing valve spool 60 to assume the pressure R. The valve spool 60 now will move down to the position shown in FIG. 7. In the downward position, the land 64 blocks fluid port 72, and the flow chamber 68 permits communication between high pressure fluid port 73 and control port 52. The high pressure P in control port 52 moves the upper booster valve 171 upward again to close the upper exhaust valve 22 by low pressure R communicated through the booster valve to the port 172, which allows high pressure P acting on the piston actuator 174 to close the valve member 113; and the high pressure in control port 52 acting against piston surface area 180 in the lower fuel injector 21 moves the same upward in a reset position ready for the next injecton cycle.

Summarizing over all operation of the free piston engine pump 1, the internal combustion process is employed to drive the member 3 to pressurize a hydraulic working fluid. The sequence of events experienced during such operation is graphically charted in FIG. 9, and is described below with reference thereto.

Fresh air enters the common intake pipe 91. Assuming the member 3 is moving upward, the common scavenge air control valve 90 is in position to permit fresh air to pass through the upper intake pipe 93 into the upper scavenge chamber 13. At TDC of the member 3, the valve 90 reverses to close the upper intake pipe 93, and during downward movement of the member 3 the air in the upper scavenge chamber 13 is compressed. When member 3 reaches BDC, the upper air intake port 17 communicates past the upper surface of the upper power piston 6 to deliver air into the upper combustion chamber 11. As the member 3 reverses, the inertia of the air tends to keep the air flowing into the combustion chamber. In addition, at BDC the common scavenge air control valve 90 operates to open the upper intake pipe 93 and, again, due to air inertia, fresh air flows into the upper scavenge chamber 13 even though the member 3 is not moving up at a significant velocity. All these events tend to supercharge the upper combustion chamber 11.

The fresh air in the upper combustion chamber 11 is compressed as the upper power piston 6 continues to move upward. Near TDC the upper fuel injector 20 injects fuel into the upper combustion chamber 11, and pressure initiated combustion of the fuel occurs. The motion of the member 3, then, reverses.

Near BDC of the member 3, the burned gases in the upper combustion chamber 11 are allowed to pass through the upper exhaust valve 22. Such exhaust valve is opened suddenly, and the upper exhaust pipe 102 and common exhaust pipe 101 cause the gas velocity to be high enough so that a partial vacuum is drawn in the combustion chamber and the kinetic energy of the gases is converted to pressure in the plenum 104.

The common exhaust valve 103, which, as noted above, has a loose fit, closes against the upper exhaust pipe 102 trapping the high pressure gases in the plenum 104. At the same time the upper exhaust valve 22 closes preventing the fresh air charge entering the upper air intake port 17 from being lost through the upper exhaust valve. The partial vacuum in the upper exhaust pipe 102 is at least partially replenished at this time due to the flow of cool air from the intake pipe 15 and upper cooling air passage 111, which air also tends to reduce the cooling load on the upper exhaust valve 22. The plenum 104 can exhaust to atmosphere or, if desired, may drive an exhaust turbine 110.

As is evident in FIG. 1, during upward movement of the member 3, low pressure hydraulic fluid will flow into the upper pump chamber 15 through the upper input check valve 29, and hydraulic fluid in the lower pump chamber 16 will be pumped at relatively high pressure through the lower output check valve 32. Similarly, during downward movement of the member 3, the upper pump piston 8 pumps hydraulic fluid from the upper pump chamber 15 through the upper output check valve 31 while hydraulic fluid at low pressure flows into the lower pump chamber 16 through the lower input check valve 30, and so on, to obtain a continuous relatively high pressure fluid output from the free piston engine pump 1 at the high pressure hydraulic fluid output line 25.

Start-up of the free piston engine pump 1 is achieved by cycling the same forcefully by a starting mechanism, such as the one illustrated and described in U.S. Pat. No. 4,087,205. The objective of such starting mechanism is to apply fluid pressure to the respective upper and lower pump chambers 15, 16 in a cyclic manner that effects reciprocating of the member 3 until there is adequate travel of the member and pressure in the respective combustion chambers 11, 12 to obtain self-sustaining combustion operation. Sufficient amplitude of motion of the member 3 will be indicated by high pressure appearing at port 81 when the lower flow annulus 87 provides communication between high pressure port 83 and port 81. Such high pressure at port 81 allows the phasing valve 50 to operate, and the cycling starting operation is gradually closed off as is explained in such patent.

Since there is a gradual transition to self-sustaining operation, whatever fuel regulation mechanism is employed in the free piston engine pump can have adequate time to react to the operating frequency of the free piston engine pump 1. The preferred fuel regulation mechanism is by orifice flow from a fuel pressure source which varies as the square of the hydraulic pumping pressure output, generally the high pressure P, directly from the free piston engine pump 1 and, particularly, the high pressure hydraulic fluid in the output line 25.

Figure 8B:
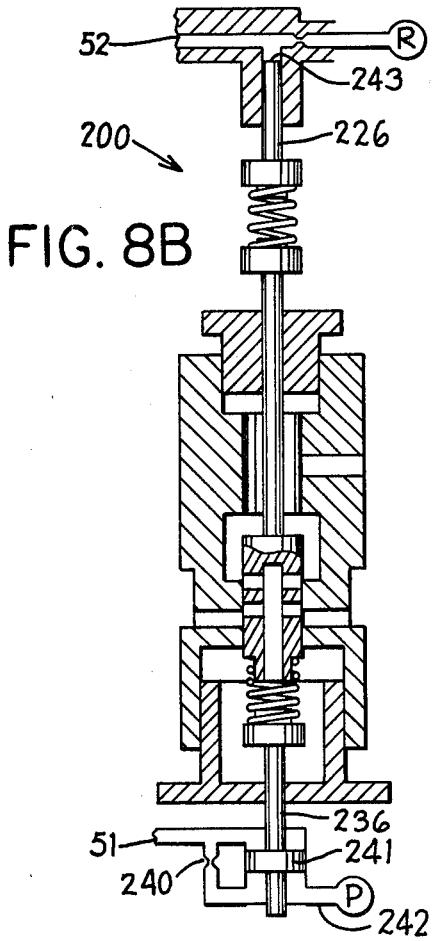
FIGS. 8A and 8B are section views, partly in schematic form, of a cycling valve mechanism for the free piston engine pump.
Figure 8A:
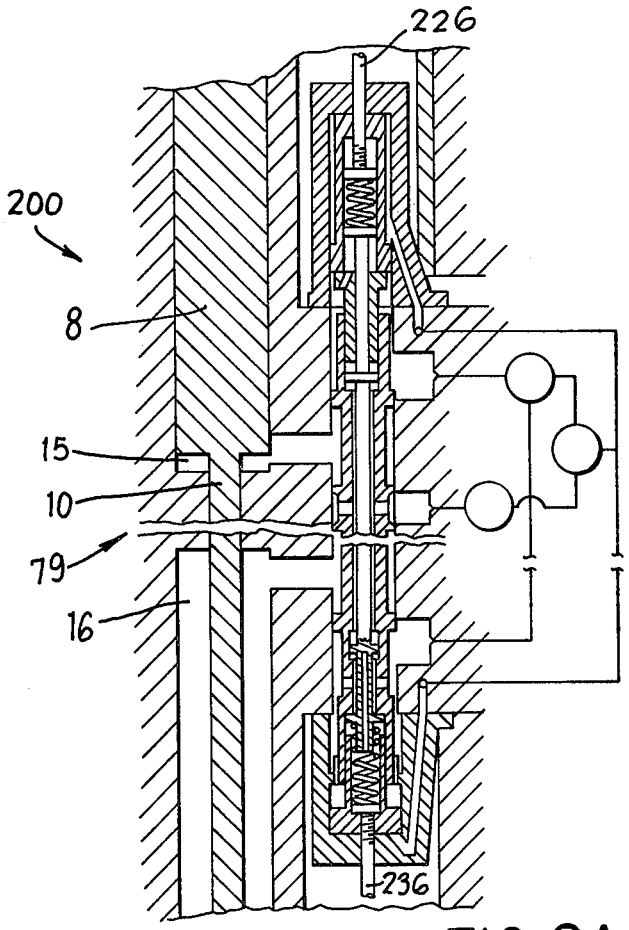

The cycling valve assembly 200 illustrated in FIGS. 8 and 8B is structurally and operationally substantially identical to the cycling valve assembly disclosed in FIGS. 5 and 5A of U.S. Pat. No. 4,087,205. Therefore, such assembly will not be described in detail; rather the disclosure relating to the same is hereby specifically incorporated by reference to such patent. Moreover, an electrical circuit for controlling operation of the cycling valve assembly of FIGS. 8A and 8B also is disclosed in such patent, and the disclosure thereof also is hereby specifically incorporated by reference as an example of a circuit that may be employed in accordance with the present invention.

The principal difference between the cycling valve assembly 200 of FIGS. 8A and 8B and that disclosed in such patent, is the manner in which information concerning the position of the member 3 is communicated to toggle pins 226, 236 of the cycling valve assembly. Instead of direct confrontation or mechanical abutment of the toggle pins 226, 236 with the power pistons 6, 7 or other portions of the member 3, the toggle pins 226, 236 operate in response to fluid pressures in the control ports 6, 8 of the phasing valve 50. Thus, whenever the lower flow annulus 87 and phasing valve 50 provide high fluid pressure (see FIG. 4) to the control 51, a pressure differential is created across an orifice 240 and across a toggle piston actuator 241 causing the latter to move downward (FIG. 8B) pulling the toggle pin 236 also downward. However, when the lower flow annulus 87 moves further upward (FIG. 5) to move the phasing valve spool 60 upward approximately at TDC of the member 3, low pressure is provided in control port 51, whereupon high pressure from bias port 242 operates against the toggle piston actuator 241 driving the same and the toggle pin 236 upward. The toggle pins 226 and 236 correspond with the toggle pins 126, 136 of such patent and have the same operational effect on the cycling valve assembly 200 as in the cycling valve assembly 101 of such patent. Similarly, when high pressure P occurs at control port 52, this happening when the member 3 reaches approximately the BDC (see FIG. 7) causing the phasing valve spool 60 to reassume its lowermost position, such high pressure P acts against the upper piston surface 243 of the toggle pin 226 driving the same downward to effect the same action as occurred when the toggle pin 126 was moved downward in cycling valve 101 of such patent. The remaining details of operation of the cycling valve assembly 200 to effect start-up or restart of the free piston engine pump 1 are apparent from the drawings, particularly FIGS. 8A and 8B, taken together with the corresponding description presented in the U.S. Pat. No. 4,087,205 directed to the cycling valve assembly 101 thereof.

It will, of course, be appreciated that other types of starting mechanisms may be employed in the free piston engine pump 1 of the present invention.

Figure 10:
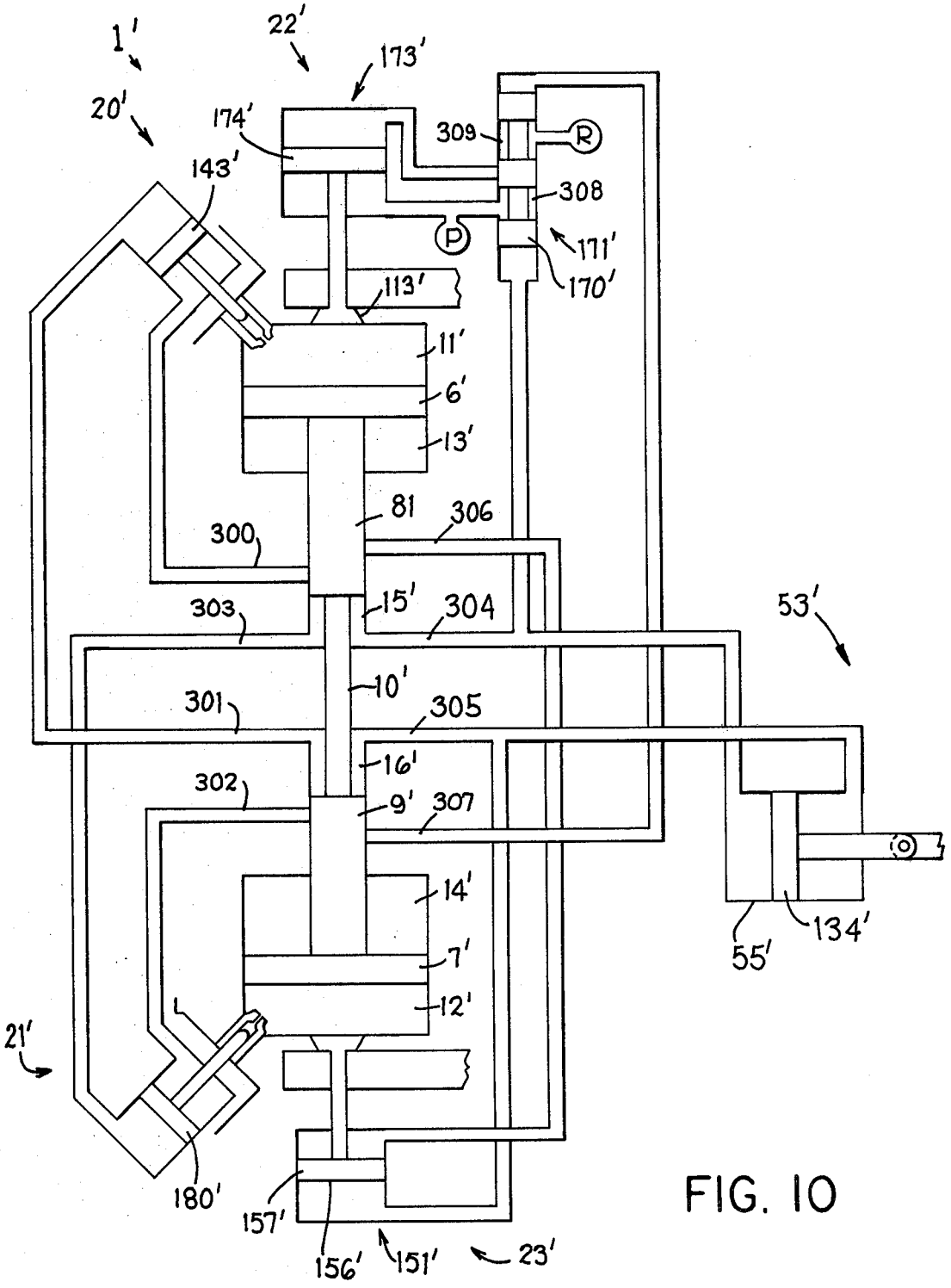
FIG. 10 is a section view, partly in schematic form, of a free piston engine pump in accordance with the present invention showing a number of alternate features that may be included independently or in combination in the free piston engine pump of FIG. 1, for example.

Referring now briefly to FIG. 10, several alternate porting arrangements for controlling operation of the upper and lower fuel injectors 20, 21, upper and lower exhaust valves 22, 23, and the hydraulic fluid scavenge/plenum actuator 55, which operates the common scavenge air control and exhaust or plenum valves 90, 103, in dependence on the main reciprocating member 3, are illustrated. In the free piston engine pump 1' of FIG. 10, wherein primed reference numerals designate above-described parts designated by unprimed reference numerals, there is no phasing valve. The fluid pressures in ports 300, 301 control injecting and resetting of the upper fuel injector 20'. Port 300 communicates with the upper pump chamber 15', and port 301 communicates with lower pump chamber 16'. The ports 300, 301, more particularly, communicate directly with opposite sides of a fuel injecting piston actuator 143' such that injection of fuel into the upper combustion chamber 11' occurs when the pressure in port 301 exceeds that in port 300; and when the pressure in port 300 exceeds that in port 301 the injector piston actuator 143' is retracted in preparation for another cycle. Port 300 does not communicate full time with the upper pumping chamber 15'; rather, port 300 terminates in the cylinder wall of which the upper pump chamber is formed so that such communication is established only when the upper pump piston 8' has proceeded a sufficient distance in an upward direction. Thus, the intent is for the upper fuel injector 20' to inject fuel just before the upper power piston 6' reaches TDC. Such injection is accomplished, then, by the pressure in port 301 achieving a high level P all the time that the member 3' is moving upward; however, since free communication of port 300 with the upper pump chamber 15' is blocked, the pressure in port 300 also is high and the piston actuator 143' will not move. At the point when it is desired to start the injection sequence, the upper pump piston 8' uncovers port 300 to permit movement of the piston actuator 143' to inject fuel into the upper combustion chamber 11'. Moreover, as soon as the member 3' reverses direction, the pressures in ports 300, 301 reverse, and the piston actuator 143' retracts. An entirely similar sequence of events occurs for the lower fuel injector 21'. Ports 302, 303 provide the same function operating the injector piston actuator 180' of the lower fuel injector 21' as ports 300, 301, respectively, in association with the upper fuel injector 20'.

Operation of the hydraulic fluid scavenge/plenum actuator 55' is effected directly in response to fluid pressures in ports 304, 304, which are continuously communicating, on the one hand, with the upper and lower pump chambers 15', 16', respectively, and with opposite surfaces of the actuator piston 134'. Therefore, as the member 3' moves down (or up), the piston 134' is moved to the right (or to the left, respectively) to operate the common scavenge air control and common exhaust or plenum valves 90', 103', as aforesaid.

Figure 9:
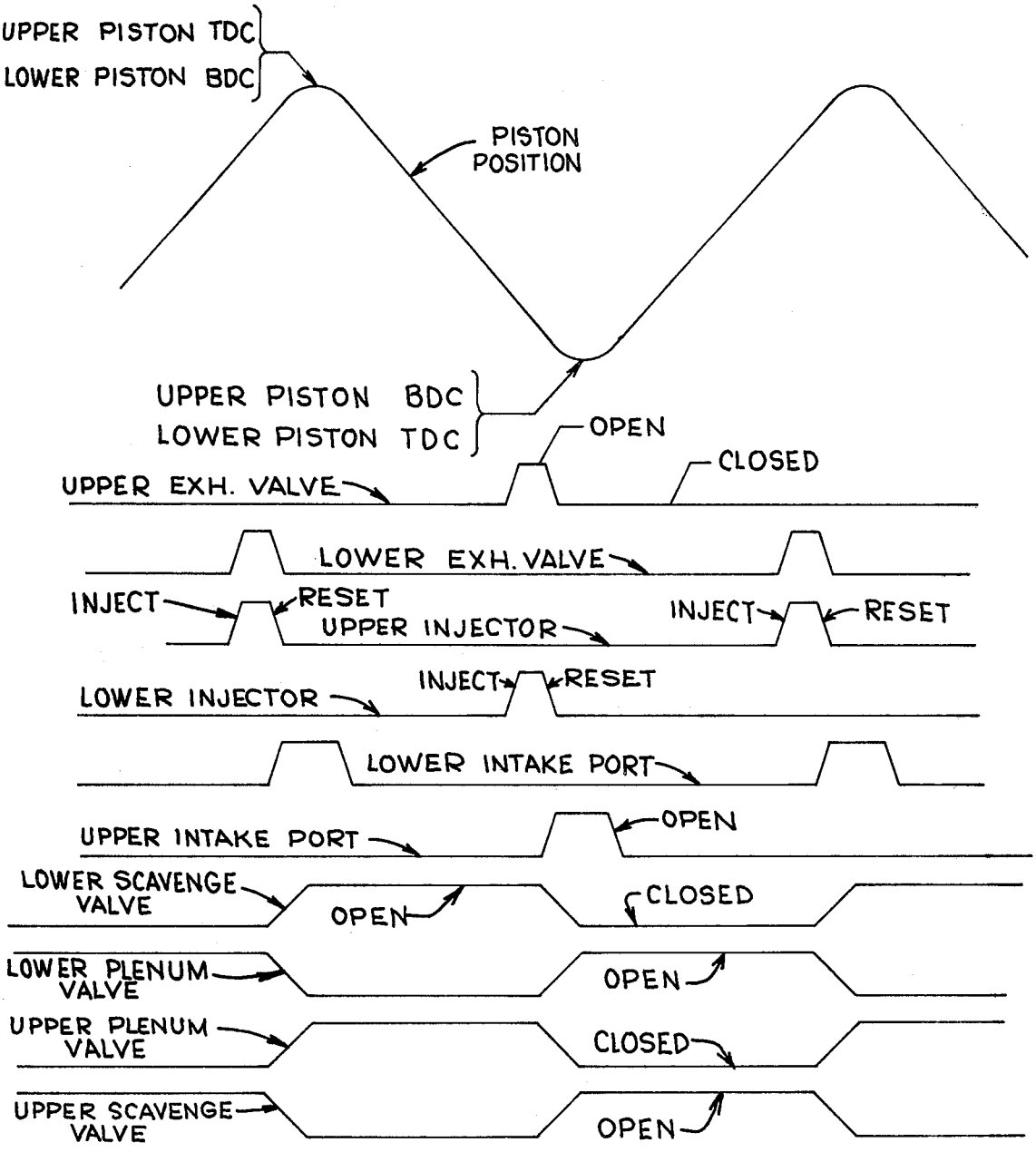
FIG. 9 is a graphical sequence diagram illustrating the occurrence of various events in the free piston engine pump.

Two versions or embodiments of means for controlling the exhaust valves 22, 23 are illustrated in FIG. 10, and either or both may be employed in, for example, a free piston engine pump in accordance with the present invention. The lower exhaust valve actuator 151' is directly actuated by fluid pressures developed in response to movement of the member 3', whereas the upper exhaust valve actuator 173' is indirectly controlled by an upper booster valve 171'. Referring to the lower exhaust valve 23', it is desired to open the same at some point before the member 3' reaches its uppermost position. Pressure in port 305, which is the same as the pressure in port 301 that operates the upper fuel injector 20', is delivered to the surface 156' of the piston actuator 157'. The pressure in port 305 will effect opening of the lower exhaust valve 23' when such pressure exceeds that in port 306. Port 306 terminates in the cylinder wall of the upper pump chamber 15' in the manner similar to port 300. Operation of the lower exhaust valve actuator 151', then, is similar to the previously described operation of the upper fuel injector 20'. Opening of the lower exhaust valve 23', therefore, occurs at approximately the same time as injection of fuel by the upper fuel injector 20'. As soon as the member 3' reverses direction, pressures in ports 305, 306, reverse, and the lower exhaust valve actuator 151' closes the lower exhaust valve 23'. Such closure ordinarily is not at the point at which the exhaust valve would close in a conventional two cycle engine; rather, the closure obtained in the present invention, as illustrated in a time-sequence frame depicted in FIG. 9, is desirable in order to employ the scavenging method of the present invention described above. Ports 300 and 306 could terminate at the same point in the cylinder wall of the upper pump chamber 15', if desired. In that event, injection of fuel into the upper combustion chamber 11' would commence at the same time as lower exhaust valve 23' is opened. This feature could still be used even if injection should occur later by incorporating a time delay in port 300 such that the pressure in port 306 is first transmitted to the lower exhaust valve 23'.

Indirect actuation of the upper exhaust valve 22' (which also may be employed in connection with the lower exhaust valve as well) employs the booster valve 171'. The spool 170' will move up and down according to the fluid pressures in ports 304 and 307. When the pressure in port 304 exceeds that in port 307 due to downward movement of the member 3', the spool 170' is moved upward so that high pressure P is applied through flow annulus 308 to the upper surface of actuator piston 174' moving the latter and the exhaust valve member 113' downward to open exhaust valve 22'. Reversal of the position of the booster valve 171' ports low pressure to the upper surface of the actuator piston 174' through flow annulus 309, whereupon the actuator piston 174' moves upward to close the upper exhaust valve 22'.

Operation of the free piston engine pump 1' illustrated in FIG. 10 will be otherwise substantially the same as that described above with reference to the pump 1 or, alternatively, the various modifications illustrated in FIG. 10 may be incorporated in the free piston engine pump 1.

The embodiments of the invention in which an exclusive property or privilege is claimed are defined as follows:

1. A free piston engine pump, comprising in combination: housing means defining therein first and second bore means; a main reciprocating member including first and second piston means slidably disposed in said first and second bore means respectively, and means for interconnecting said piston means for simultaneous reciprocating movement; each said piston means including a power piston coacting with the respective bore means to define a combustion chamber adjacent one end thereof, each said piston means also including a pumping piston fixed relative to the power piston and coacting with the respective bore means to define a pumping chamber adjacent the other end thereof; discharge passage means for discharging the exhaust gases from the combustion chamber, said discharge passage means comprising first and second exhaust passage means for removing exhaust products of combustion from the respective combustion chambers; common exhaust outlet means for discharging such exhaust products of combustion from the engine, and common exhaust valve means for controlling the connections of said respective passage means to said common exhaust outlet means; separate exhaust valve means associated with each of said respective combustion chambers for selectively opening the same to discharge exhaust products of combustion to said discharge passage means; and cooling means for delivering cooling air to said discharge passage means proximate said respective exhaust valve means, said cooling means comprising a common air intake means for receiving cooling air, separate cooling air passages for delivering cooling air to said respective exhaust passage means, and common cooling air control valve means for selectively delivering cooling air through said respective cooling air passages; and means for simultaneously operating said common exhaust valve means and said common cooling air control valve means.

2. The pump of claim 1, each of said common exhaust valve means and said common cooling air control valve means comprising a respective flapper, a common shaft means for mounting both of said flappers, and actuator means for rotating said shaft and, thus, said flappers for simultaneous common operation of the same.

3. The pump of claim 2, further comprising common combustion air intake means for receiving fresh air, first and second passage means for delivering such fresh air to said respective combustion chambers to support combustion therein, and common intake valve means for controlling the flow of air from said common combustion air intake means to said respective passage means to enable combustion of fuel in said respective combustion chambers, and means for coupling said actuator to said common intake valve means for operating the same simultaneously with said common exhaust valve means and said common cooling air control valve means.

4. A free piston engine pump, comprising housing means defining therein first and second coaxially aligned and axially spaced bore means; first and second piston means slidably disposed in said first and second bore means, respectively, said first and second piston means being fixedly interconnected for simultaneous reciprocating movement; each said piston means including a power piston coacting with the respective bore means to define a combustion chamber adjacent one end thereof, each said piston also including a pumping piston fixed relative to the power piston and coacting with the respective bore means to define a pumping chamber adjacent the other end thereof; common air intake means for receiving air, first and second passage means for delivering air to said respective combustion chambers, and common intake valve means for controlling the flow of air from said common air intake means to said respective passage means to enable combustion of fuel in said respective combustion chambers; and actuator means for operating said common intake valve means, and control means for controlling said actuator means to effect control of intake air to deliver the same to respective combustion chambers in dependence on position of said fixedly interconnected first and second piston means, said actuator means comprising a fluid actuator, and said control means comprising an intermediate phasing valve means operative in dependence on the position of said fixedly interconnected first and second piston means for controlling flow of fluid to said actuator means to operate said common intake valve means.

5. The pump of claim 4, said common intake valve means comprising a flapper valve.

6. The pump of claim 4, further comprising respective exhaust passages leading from respective combustion chambers, a common exhaust passage for delivering exhaust product from said exhaust passages, a common exhaust valve means for selectively coupling respective exhaust passages to said common exhaust passage, and means for coupling said common exhaust valve means to said actuator means for simultaneous parallel operation with said common intake valve means.

7. The pump of claim 4, said housing means also defining a scavenge chamber adjacent each combustion chamber and separated from the latter by a respective power piston; each power piston cooperating with respective scavenge chambers to compress air therein during part of the piston stroke; said passage means comprising respective air intake passages coupled to deliver intake air to respective scavenge chambers, and air porting means for delivering air from the respective scavenge chamber to the corresponding combustion chamber when the respective power piston is at least proximate a bottom dead center position.

8. The pump of claim 7, said air passage means comprising means for delivering air through a respective scavenge chamber to a respective combustion chamber through said port means.

9. A free piston engine pump, comprising housing means defining therein first and second coaxially aligned and axially spaced bore means; first and second piston means slidably disposed in said first and second bore means, respectively, said first and second piston means being fixedly interconnected for simultaneous reciprocating movement; each said piston means including a power piston coacting with the respective bore means to define a combustion chamber adjacent one end thereof, each said piston also including a pumping piston fixed relative to the power piston and coacting with the respective bore means to define a pumping chamber adjacent the other end thereof; and an exhaust system including first and second exhaust passage means for removing exhaust products from said respective combustion chambers, a separate exhaust valve means directly associated with each of said combustion chambers for controlling communication thereof with said respective first and second exhaust passage means, common exhaust outlet means for discharging such exhaust products from the pump, and common exhaust valve means for controlling the connection of said respective passage means to said common exhaust outlet means.

10. The pump of claim 9, further comprising control means for selectively opening and closing said respective separate exhaust valve means while said common exhaust valve means couples the corresponding exhaust passage means to said common exhaust outlet means.

11. The pump of claim 10, said control means comprising means for suddenly opening and closing said separate exhaust valve means to obtain a gas inertia effect of the exhaust products flowing in said exhaust system.

12. The pump of claim 11, each of said separate exhaust valve means including a fluid actuator for opening and closing the same, and said means for suddenly opening and closing comprising booster valve means for controlling delivery of fluid to said fluid actuator means in dependence on the position of said fixedly interconnected first and second piston means in said housing means.

13. The pump of claim 10, said control means comprising fluid actuator means for opening and closing said separate exhaust valve means, and operating means for operating said fluid actuator means in response to operation of said fixedly interconnected first and second piston means.

14. The pump of claim 13, said operating means comprising intermediate phasing valve means for controlling fluid pressure connections to said fluid actuator means in response to the relative position of said fixedly interconnected first and second piston means in said housing means.

15. The pump of claim 14, said fluid actuator means comprising piston actuator means for moving said separate exhaust valve means and booster valve means in response to a fluid input from said operating means for delivering respective fluid pressures to said piston actuator means to obtain a relatively sudden opening and closing of said separate exhaust valve means and, thus, a gas inertia effect of the exhaust products flowing in said exhaust system.

16. The pump of claim 9, said common exhaust valve means comprising a flapper valve.

17. The pump of claim 16, further comprising fluid actuator means for operating said common exhaust valve means and control means for controlling said actuator means to effect such operation in response to position of said fixedly interconnected first and second piston means in said housing means.

18. The pump of claim 17, further comprising respective air intake passages for delivering air to said respective combustion chambers, a common air intake passage for delivering air to said respective air intake passages, a common air intake valve means for selectively coupling respective air intake passages to said common air intake passage, and means for coupling said common air intake valve means to said actuator means for simultaneous parallel operation with said common exhaust valve means.

19. A free piston engine pump, comprising housing means defining therein first and second coaxially aligned and axially spaced bore means; first and second piston means slidably disposed in said first and second bore means, respectively, said first and second piston means being fixedly interconnected for simultaneous reciprocating movement; each said piston means including a power piston coacting with the respective bore means to define a combustion chamber adjacent one end thereof, each said piston also including a pumping piston fixed relative to the power piston and coacting with the respective bore means to define a pumping chamber adjacent the other end thereof; and fuel input means responsive to fluid pressure in at least one of said pumping chambers for supplying combustible fuel into respective combustion chambers, said fuel input means comprising fluid responsive actuator means for supplying fuel to said combustion chambers, and valve means operable in response to said fixedly interconnected first and second piston means for controlling flow of fluid to said actuator means selectively to inject fuel into said combustion chambers.

20. The pump of claim 19, said actuator means comprising a separate fluid actuator for each combustion chamber, and said valve means comprising spool valve means common to both fluid actuators for selectively supplying fluid to operate respective fluid actuators to inject fluid.

21. The pump of claim 20, each of said fluid actuators comprising actuator piston means movable in response to a pressure differential thereacross in one direction for injecting fuel and in an opposite direction for resetting ready for a subsequent injection.

22. The pump of claim 21, said spool valve means including a flow controlling spool movable to respective positions in a valve housing in dependence on the position of said fixedly interconnected first and second piston means in said housing means.

23. A free piston engine pump, comprising housing means defining therein first and second coaxially aligned and axially spaced bore means, first and second piston means slidably disposed in said first and second bore means, respectively, said first and second piston means being fixedly interconnected for simultaneous reciprocating movement as a main reciprocating member; each said piston means including a power piston coacting with the respective bore means to define a combustion chamber adjacent one end thereof, each said piston also including a pumping piston fixed relative to the power piston and coacting with the respective bore means to define a pumping chamber adjacent the other end thereof; air intake means for delivering air to said combustion chambers to support combustion therein; fuel input means for delivering fuel to said combustion chambers for combustion therein; exhaust means for passing exhaust products of combustion from said combustion chambers after combustion has occurred therein; and phasing valve means operative in response to the operative position of said fixedly interconnected first and second piston means for controlling operation of one of said air intake means, fuel input means, and exhaust means; said phasing valve means comprising a spool valve including a flow controlling spool movable to respective positions in a valve housing in dependence on the position of said fixedly interconnected first and second piston means.

24. The pump of claims 23, wherein all of said air intake means, fuel input means and exhaust means are controlled by said phasing valve means.

25. The pump of claims 19 or 23, further comprising common air intake means for receiving air, first and second passage means for delivering air to said respective combustion chambers, and common intake valve means for controlling the flow of air from said common air intake means to said respective passage means to enable the combustion of fuel in said respective combustion chambers.

26. The pump of claims 19 or 23, further comprising first and second exhaust passage means for removing exhaust products of combustion from said combustion chambers, common exhaust outlet means for discharging such exhaust products of combustion from the engine, and common exhaust valve means for controlling the connections of said respective passage means to said common exhaust outlet means.

27. The pump of claim 26, further comprising fluid actuator means coupled to said phasing valve means for operating said common exhaust valve means to respective positions.

28. The pump of claim 26, further comprising a separate exhaust valve means directly associated with each of said combustion chambers for controlling communication thereof with said respective first and second exhaust passage means.

29. The pump of claim 28, further comprising control means for selectively opening and closing said respective exhaust valve means while said common exhaust valve means couples the corresponding exhaust passage means to said common exhaust outlet means.

30. The pump of claim 29, further comprising fluid actuator means coupled to said phasing valve means for operating said common exhaust valve means to respective positions, and control means for coupling said phasing valve means to said exhaust valve means for operating the same to exhaust respective combustion chambers.

31. The pump of claim 26, further comprising common air intake means for receiving air, first and second passage means for delivering air to said respective combustion chambers, and common intake valve means for controlling the flow of air from said common air intake means to said respective passage means to enable the combustion of fuel in said respective combustion chambers.

32. The pump of claim 31, further comprising air control actuator means for operating said common intake valve means and control means for controlling said actuator means to effect such operation in response to the operative position of said fixedly interconnected first and second piston means in said housing means, and means for coupling said actuator means to said common exhaust valve means for operating the same simultaneously and in parallel with said common intake valve means.

33. The pump of claim 29, said main reciprocating member comprising a flow control means for operating fluid flow to said spool valve, input port means for coupling sources of high and low pressure fluid to said flow control means and output port means for coupling fluid pressure from said flow control means to said spool valve to effect movement of said spool means in said valve housing, and interconnect means for fluidically coupling said output port means to respective ones of said input port means when said fixedly interconnected first and second piston means is at least near respective opposite extremities of movement thereof in said housing means.

34. The pump of claim 33, said spool valve including bias means for biasing said spool means to one position in said valve housing and said flow control means being coupled by said output port means to said valve housing to deliver fluid at relatively high pressures thereto to effect movement of said spool means in one direction against said bias means and to deliver fluid at relatively low pressure thereto for releasing said spool means to move in an opposite direction in response to force from said bias means.

35. The pump of claim 34, said bias means comprising a source of fluid pressure applied to one surface of said spool means and said flow control means including a flow annulus in a surface of said fixedly interconnected first and second piston means, said flow annulus being effectively movable in a bore in said housing means, and said surface being cooperative with said bore to block fluid flow in said output port means thereby to hold said spool means in respective positions in said valve housing when said flow annulus is not positioned to coupled said output port means to a respective inlet port means.

36. The pump of claim 35, further comprising rod means for interconnecting said first and second piston means, said flow annulus comprising a pair of flow annuli, each being positioned in said rod means relatively proximate respective pumping pistons and fluidically isolated from said respective pumping chambers.

37. A free piston engine pump unit, comprising in combination: housing means defining therein first and second coaxially aligned and axially spaced bore means; first and second piston means slidably disposed in said first and second bore means respectively, said first and second piston means being fixedly interconnected for simultaneous reciprocating movement; each said piston means including a power piston coacting with the respective bore means to define a combustion chamber adjacent one end thereof, each said piston means also including a pumping piston fixed relative to the power piston and coacting with the respective bore means to define a pumping chamber adjacent the other end thereof; supply conduit means connecting to said pumping chambers for supplying a working fluid thereto; discharge conduit means connected to said pumping chambers for permitting the working fluid to be discharged therefrom; inlet and discharge passage means connected to the combustion chambers for respectively supplying air therto and discharging exhaust gases therefrom; control means for supplying pressurized working fluid into said pumping chambers to drivingly reciprocate said first and second piston means during start-up of the engine, said control means including first and second control conduits communicating with the pumping chambers of the first and second bore means respectively; said control means also including shiftable control valve means associated with said first and second control conduits for alternately and sequentially permitting the flow of high pressure working fluid to the pumping chambers to drivingly reciprocate the piston means back-and-forth until the engine is started, said control valve means being movable between a first end position wherein high pressure working fluid is supplied to one of the pumping chambers and a second end position wherein high pressure working fluid is supplied to the other pumping chamber; said control valve means including a slidably shiftable sleevelike shuttle valve for controlling the flow of pressure fluid through said first and second conduits, and a toggle valve slidably supported in said sleevelike shuttle valve and shiftable axially with respect thereto, said shuttle and toggle valves being slidably reciprocal between said first and second end positions; said control valve means also including fluid chambers associated with the opposite ends of said toggle and shuttle valves, and porting means cooperating with said fluid chambers for supplying pressurized working fluid thereto to cause a pressure force to be imposed axially on the shuttle and toggle valves to assist in rapid shifting of the respective valve toward one of said end positions after it has been moved slightly away from the other end position; and fluid pressure responsive means coupled to receive a fluid input representative of the position of said fixedly interconnected first and second piston means in said housing means for initiating automatic shifting of said control valve means between said first and second end positions in response to reciprocating movement of said first and second piston means during start-up of the engine.

38. The pump of claim 37, said fluid pressure responsive means comprising first and second movable pistons, means for coupling fluid to said movable pistons to effect movement of respective ones of the same in response to movement of the respective power pistons into their innermost positions in said housing means thereby to effect movement of said respective movable pistons, and means for coupling movement of said movable pistons to respective ends of said toggle valve, whereby movement of the respective power piston into its innermost position causes fluid to be delivered to a respective movable piston moving the same to cause the toggle valve to be slightly moved away from one of the end positions, whereupon the fluid chambers then apply a fluid shifting force to the valves to positively move the same into the other end position.

39. The pump of claim 37, further comprising fluid-urged centering pistons cooperating with said valves for moving said valves into a centered position after the engine has started.

40. The pump of claims 37, or 39 comprising rod means for interconnecting said first and second piston means, said bore means including a portion for close containment of said rod means, fluid pressure port means coupled to said portion of said bore means to deliver fluid thereto, and flow annulus means in said rod means for selectively coupling fluid pressure from said port means to said fluid pressure responsive means in dependence on the position of said rod means in said portion of said bore means.

41. The pump of claim 40, said flow annulus means comprising two flow annulus means, one at respective opposite halves of said rod means for respective fluid connections at opposite ends of the stroke of said first and second piston means.

42. The pump of claim 40, further comprising phasing valve means operative to respective positions in dependence on the position of said flow annulus means in said portion of said housing means and, thus, the position of said first and second piston means for controlling delivery of fluid from said flow annulus means to said fluid pressure responsive means.

* * * * *

UNITED STATES PATENT AND TRADEMARK OFFICE

CERTIFICATE OF CORRECTION

PATENT NO. : 4 369 021

DATED : January 18, 1983

INVENTOR(S) : Richard P. Heintz

It is certified that error appears in the above-identified patent and that said Letters Patent is hereby corrected as shown below:

Col. 18, line 34; change "claims" to ---claim---.

Col. 19, line 24; change "29" to ---23---.

Col. 19, line 56; change "coupled" to ---couple---.

Col. 21, line 8; change "comprising" to ---, further comprising---.

Signed and Sealed this

*Fourteenth* Day of *June 1983*

[SEAL]

*Attest:*

DONALD J. QUIGG

*Attesting Officer*

*Acting Commissioner of Patents and Trademarks*